US007621475B2

(12) United States Patent
Culley et al.

(10) Patent No.: US 7,621,475 B2
(45) Date of Patent: Nov. 24, 2009

(54) MECHANISM FOR SHAVING ICE IN A REFRIGERATION APPLIANCE

(75) Inventors: Brian K. Culley, Mt. Vernon, IN (US); Matthew W. Hartmann, Evansville, IN (US); Gary W. Wilson, Sellersburg, IN (US); Ravindra Kavchale, Madison, WI (US)

(73) Assignee: Whirlpool Corporation, Benton Harbor, MI (US)

( * ) Notice: Subject to any disclaimer, the term of this patent is extended or adjusted under 35 U.S.C. 154(b) by 140 days.

(21) Appl. No.: 11/644,310

(22) Filed: Dec. 21, 2006

(65) Prior Publication Data

US 2008/0149746 A1 Jun. 26, 2008

(51) Int. Cl.
*B02C 19/00* (2006.01)

(52) U.S. Cl. ..... 241/65; 241/92; 241/DIG. 17

(58) Field of Classification Search ..... 241/92, 241/DIG. 17, 55, 56, 65; 62/320
See application file for complete search history.

(56) References Cited

U.S. PATENT DOCUMENTS

| | | | | |
|---|---|---|---|---|
| 4,527,401 | A | 7/1985 | Nelson | |
| 4,718,610 | A | 1/1988 | Gallaher | |
| 5,007,591 | A | 4/1991 | Daniels, Jr. | |
| 5,050,777 | A | 9/1991 | Buchser | |
| 5,897,064 | A * | 4/1999 | Rupp | 241/92 |
| 6,082,130 | A | 7/2000 | Pastryk et al. | |
| 7,111,471 | B2 | 9/2006 | Yamasaki et al. | |
| 7,201,338 | B2 * | 4/2007 | Nakato et al. | 241/92 |
| 2006/0059939 | A1 | 3/2006 | An et al. | |
| 2006/0064994 | A1 | 3/2006 | Lim | |
| 2006/0065006 | A1 | 3/2006 | Park | |
| 2006/0065007 | A1 | 3/2006 | Park et al. | |
| 2006/0065008 | A1 | 3/2006 | Park | |
| 2006/0070386 | A1 | 4/2006 | An | |
| 2006/0207270 | A1 | 9/2006 | Voglewede et al. | |

FOREIGN PATENT DOCUMENTS

| | | | |
|---|---|---|---|
| JP | 60184355 | A | 9/1985 |
| JP | 4032679 | A | 2/1992 |
| JP | 5240545 | A | 9/1993 |

* cited by examiner

*Primary Examiner*—Mark Rosenbaum
(74) *Attorney, Agent, or Firm*—Kirk W. Goodwin; Greer, Burns & Crain, Ltd

(57) ABSTRACT

An ice shaving mechanism may include a blade arranged with an edge to engage an ice mass to shave a layer of ice from the ice mass. A support may be provided upon which the blade may be mounted. An opening may be arranged adjacent to the edge of the blade to permit the shaved layer of ice to pass through the opening. At least one guide surface may extend away from the opening opposite the blade to intercept the shaved layer of ice that has passed through the opening, and to direct the shaved layer in a desired direction.

15 Claims, 5 Drawing Sheets

MECHANISM FOR SHAVING ICE IN A REFRIGERATION APPLIANCE

BACKGROUND OF THE INVENTION

Appliances are known for dispensing shaved ice, such as those disclosed in U.S. Pat. Nos. 4,718,610, 4,745,773, 5,513,810 and 5,680,771. In such devices, the ice is shaved by pressing the ice against a blade oriented at a small angle relative to the ice. The ice may be moved relative to a stationary blade, or the blade may be moved relative to a stationary cube of ice. A refrigeration appliance incorporating an ice shaving mechanism is disclosed in published U.S. Patent Application 2006/0207270.

When ice is shaved, the ice shavings have a tendency to fan out from the edges of the blade, resulting in a broad, but thin, layer of ice. In countertop units, this fanning out is not a large problem because the shavings go directly from the blade to a cup or other container. However, in a refrigeration appliance, where the shavings leave the blade area and travel through an ice chute, the spreading out of the shavings results in a build-up of residual ice on the chute walls. This residual ice can cause clogging and decreased output after prolonged shaving. Also, this residual ice eventually melts, causing water to escape from the chute and collect in the drip tray. The dripping can be a cause for alarm for the user, resulting in unnecessary service calls to "fix the leak" in the dispenser.

It would be an improvement in the art if there were provided an ice shaving mechanism which prevents the fanning out of the shaved ice downstream of the ice shaving blade.

SUMMARY OF THE INVENTION

The present invention provides an ice shaving mechanism which, in some embodiments, may be mounted in a refrigeration appliance, and which prevents the fanning out of shaved ice downstream of the ice shaving blade.

In an embodiment of the invention, the ice shaving mechanism may include a blade arranged with an edge to engage an ice mass to shave a layer of ice from the ice mass. A support may be provided upon which the blade may be mounted. An opening may be arranged adjacent to the edge of the blade to permit the shaved layer of ice to pass through the opening. At least one guide surface may extend away from the opening opposite the blade to intercept the shaved layer of ice that has passed through the opening, and to direct the shaved layer in a desired direction.

In an embodiment, the opening is formed in the support.

In an embodiment, the blade is mounted in the support along an edge opposite the edge which engages the ice mass.

In an embodiment, the support integrally includes the guide surface.

In an embodiment, the guide surface comprises a wall surrounding the opening.

In an embodiment, the blade edge has two lateral ends, and the guide surface comprises a wall extending substantially perpendicular to a length of the blade edge, and arranged to intercept the shaved layer of ice to prevent the shaved layer of ice from continuing a lateral spreading of the shaved layer of ice in a direction beyond the lateral ends of the blade edge.

In an embodiment, the support comprises a replaceable cartridge in which the blade is permanently mounted adjacent to the opening and which integrally includes the guide surface in the form of a wall extending away from the opening.

In an embodiment, the cartridge includes a releasable mounting mechanism for removably securing the cartridge to a remainder of the ice shaving mechanism.

In an embodiment, the ice shaving mechanism is mounted in a refrigeration appliance which includes a refrigerated compartment, an ice making mechanism in the refrigerated compartment, an ice delivery system arranged to deliver ice from the ice making mechanism to the ice shaving mechanism, and an ice dispensing system having a vertical passage extending downwardly below the ice shaving mechanism.

DETAILED DESCRIPTION OF THE PREFERRED EMBODIMENT

Figure 1:
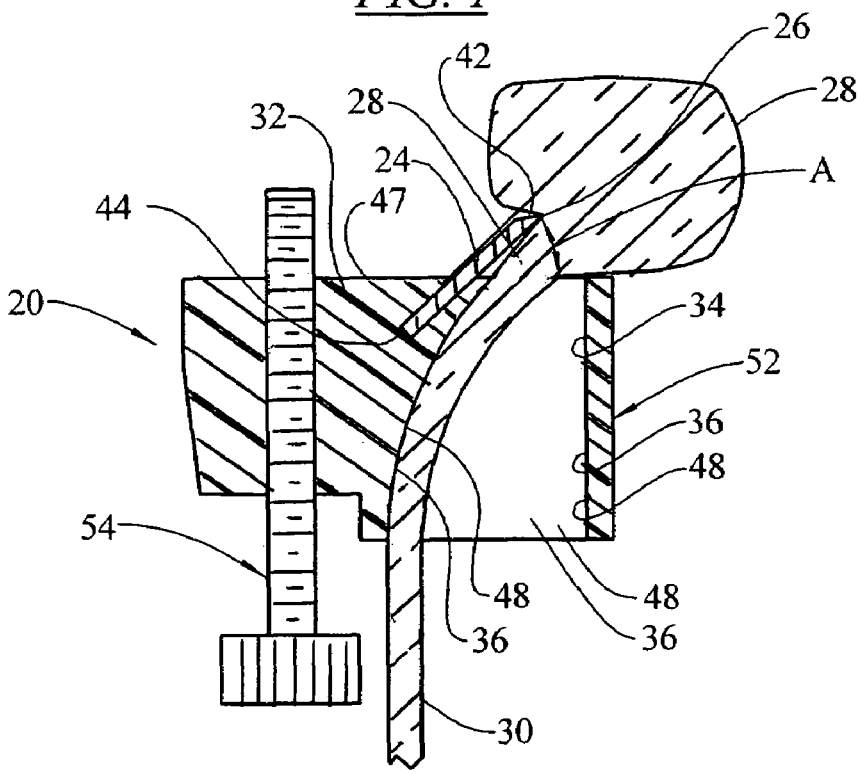
FIG. 1 is a side sectional view of a portion of the ice shaving mechanism, incorporating the principles of the present invention.
Figure 2:
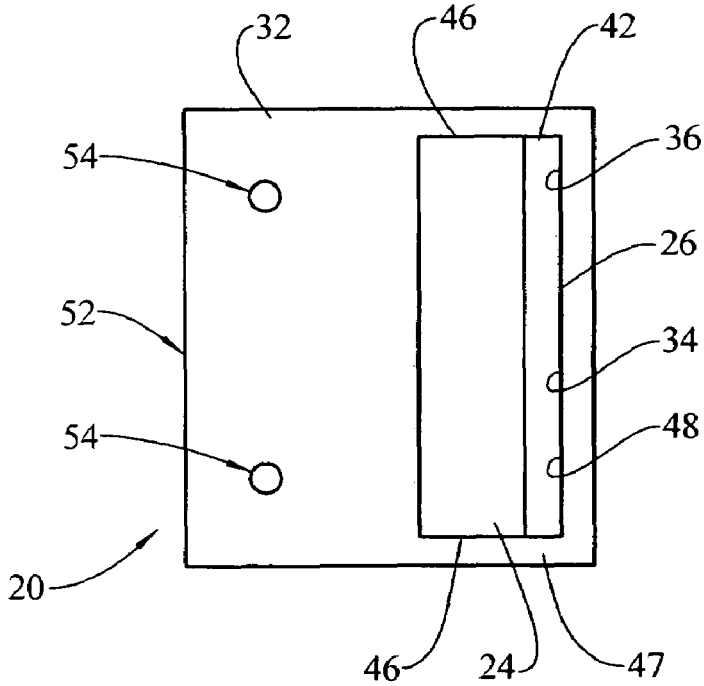
FIG. 2 is a top elevational view of the portion of the ice shaving mechanism shown in FIG. 1.
Figure 3:
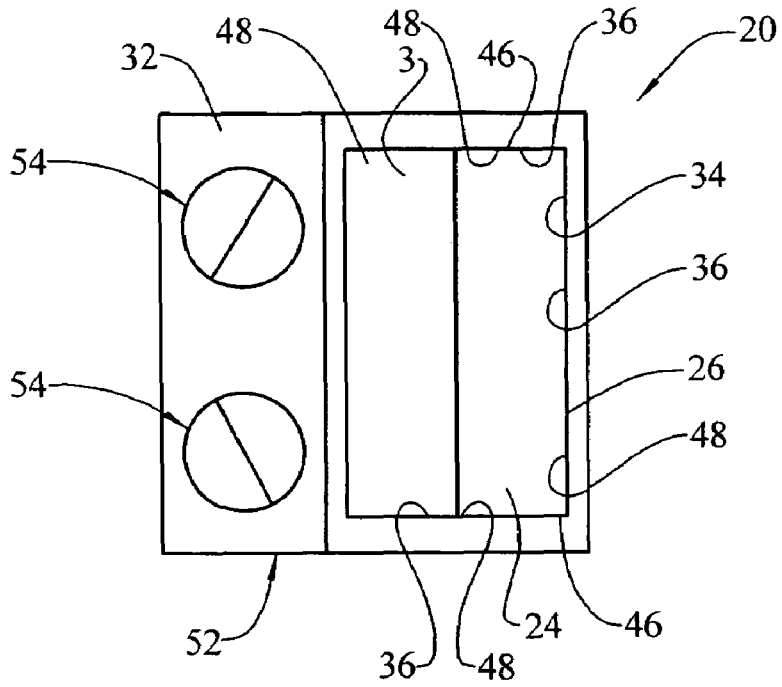
FIG. 3 is a bottom elevational view of the portion of the ice shaving mechanism shown in FIG. 1.
Figure 4:
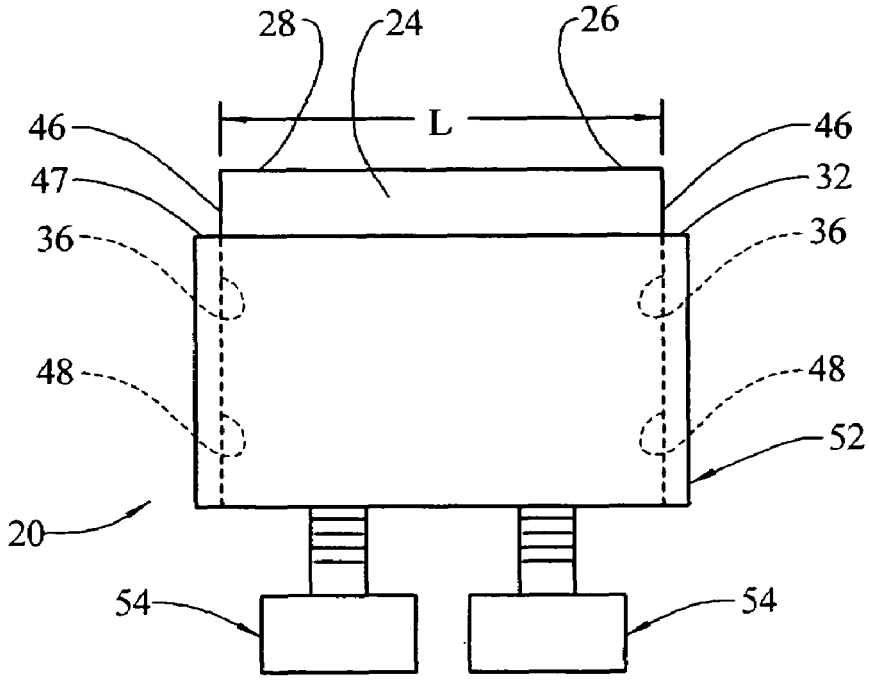
FIG. 4 is a front elevational view of the portion of the ice shaving mechanism shown in FIG. 1.
Figure 5:
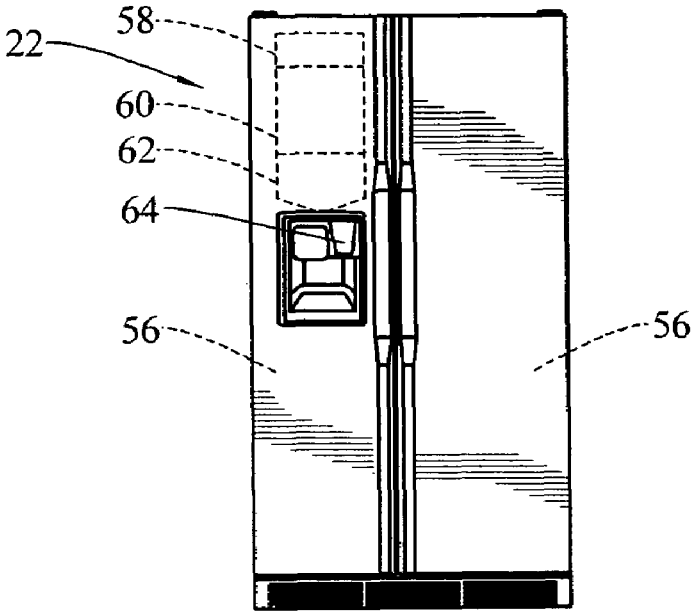
FIG. 5 is a front view of a refrigerator apparatus having a mechanism for delivering ice embodying the present invention.
Figure 6:
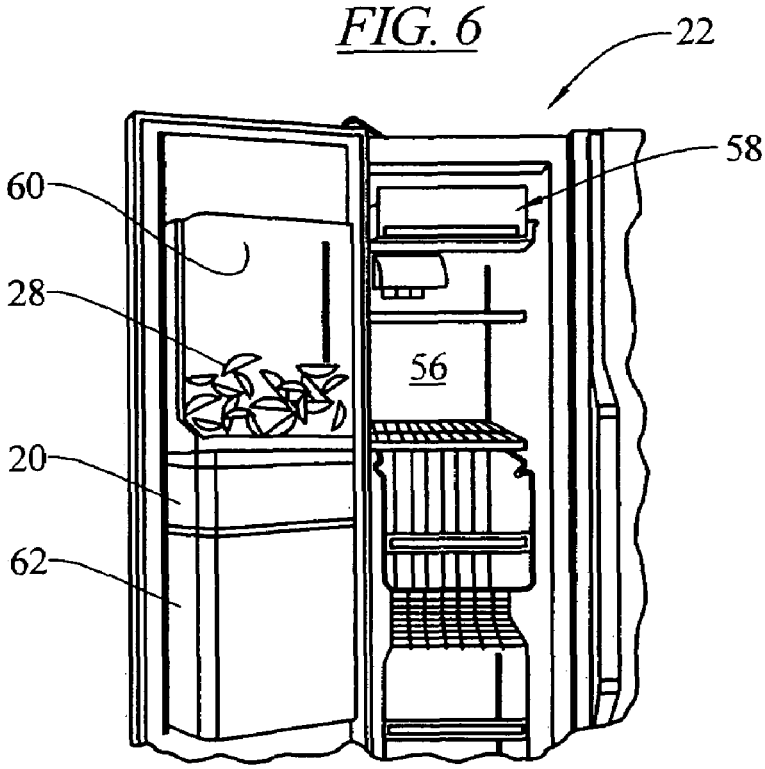
FIG. 6 is a fragmentary perspective view illustrating the mechanism within the freezer compartment of the refrigerator apparatus with the freezer door open.

The present invention provides an ice shaving mechanism 20, portions of which are shown in detail in FIGS. 1-4, which, in some embodiments, may be mounted in a refrigeration appliance 22 (FIGS. 5 and 6), such as shown and described in pending US Patent Application US2006/0207270, incorporated herein by reference.

In an embodiment of the invention as shown in FIGS. 1-4, the ice shaving mechanism 20 may include a blade 24 arranged with an edge 26 to engage an ice mass 28 to shave a layer 30 of ice from the ice mass. A support 32 may be provided upon which the blade 24 may be mounted. An opening 34 may be arranged adjacent to the edge 26 of the blade 24 to permit the shaved layer 30 of ice to pass through the opening. At least one guide surface 36 may extend away from the opening 34 opposite the blade 24 to intercept the shaved layer 30 of ice that has passed through the opening 34, and to direct the shaved layer in a desired direction.

The opening 34 may be formed directly in the support 32, or may be positioned adjacent to the support. The blade 24 may be arranged to engage the ice mass 28 at an acute angle A, and with the edge 26 of the blade which has been provided in a sharp manner, such as formed by a bevel 42 along the edge of the blade. The blade 24 may be mounted in the support 32 along an edge 44 opposite the edge 26 which engages the ice mass 28. Alternatively, the blade 24 may be held along lateral ends 46 of the blade, or the blade may be secured to the support 32 by means of a fastener, such as a threaded fastener. In any event, the ice engaging end 28 of the blade 24 protrudes above an upper surface 47 of the support 32.

In an embodiment, the support 32 may integrally include the guide surface 36, such as by forming the support and guide surfaces from a single piece of molded plastic. In other embodiments, the guide surface 36 may be formed separately from the support, and may be spaced from the support.

The guide surface 36 might include one or more walls 48 surrounding the opening 34. The walls 48, in some embodiments, might completely surround the opening 34, while in other embodiments, the walls 48 may surround only a portion of the opening. The walls 48 might be planar or they may have a curved shape, or they may be a combination of planar surfaces and curved surfaces. The opening 34 may be defined by the walls 48 and may have a rectangular or other polygonal shape, or a curved shape, such as circular or oval.

In an embodiment as illustrated in FIGS. 1-4, the blade edge 26 has the two lateral ends 46, and the guide surface 36 comprises at least one wall 48 extending substantially perpendicular to a length of the blade edge 26. The wall 48 is arranged to intercept the shaved layer 30 of ice to prevent the shaved layer of ice from continuing a lateral spreading of the shaved layer of ice in a direction beyond one or both of the lateral ends 46 of the blade edge.

In an embodiment as illustrated in FIGS. 1-4, the support 32 comprises a replaceable cartridge 52 in which the blade 24 is permanently mounted adjacent to the opening 34 and which integrally includes the guide surface 36 in the form of the wall 48 extending away from the opening. The wall 48 forms a portion of the cartridge 52 which permits grasping of the cartridge, away from the exposed sharp edge 26 of the blade 24. In this embodiment, the cartridge 52 may include a releasable mounting mechanism 54 for removably securing the cartridge to a remainder of the ice shaving mechanism 20. For example, the mounting mechanism 54 might include one or more fasteners, such as threaded fasteners.

Figure 7:
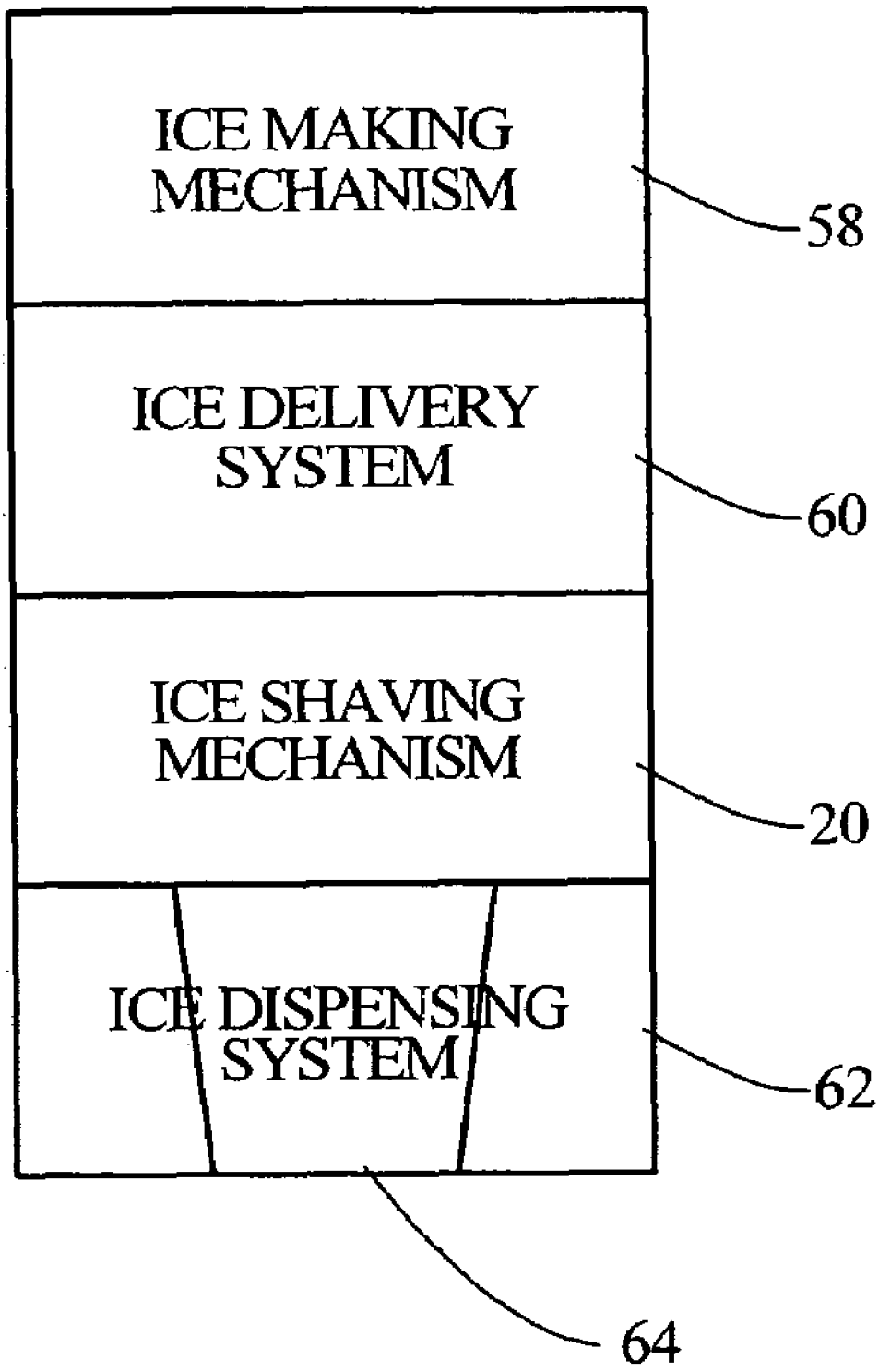
FIG. 7 is a schematic illustration of the ice shaving mechanism and appliance components.

In an embodiment, the ice shaving mechanism 20 is mounted in the refrigeration appliance 22 (FIGS. 5-7) which includes a refrigerated compartment 56, an ice making mechanism 58 in the refrigerated compartment, an ice delivery system 60 arranged to deliver ice from the ice making mechanism to the ice shaving mechanism, and an ice dispensing system 62 having a passage 64 extending downwardly below the ice shaving mechanism. The passage 64 may be arranged vertically or non-vertically.

The guide surface 36 of the ice shaving mechanism 20 serves to direct the shaved layer 30 of ice towards the passage 64 of the ice dispensing system 62, in such a manner that residual portions of the shaved layer will not collect on the sides of the main flow path of the shaved ice traveling through the passage.

Figure 8:
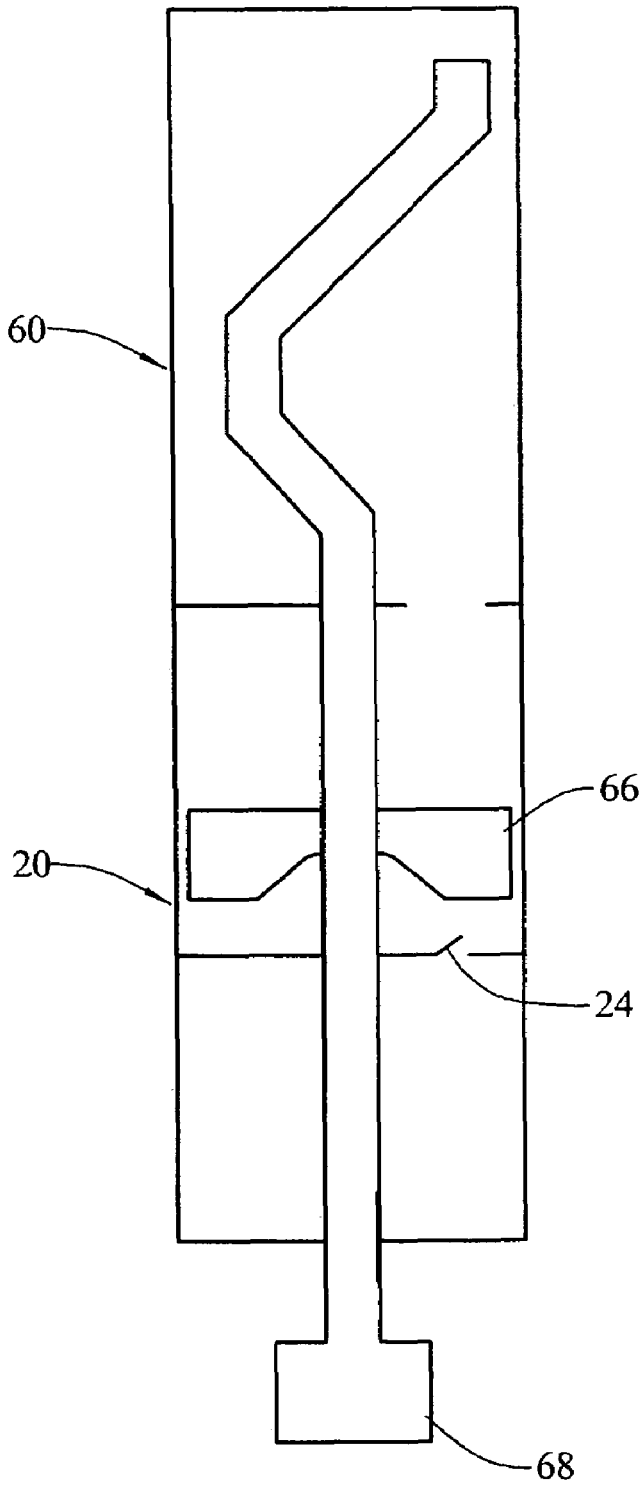
FIG. 8 is side cross sectional schematic illustration of an embodiment of the ice shaving mechanism components.

In an embodiment as shown in FIG. 8, the ice shaving mechanism 20 may include a pusher 66 and at least one of the pusher or the blade 24 may be rotated relative to the other by a motor 68. For example, the ice shaving mechanism 20 may include a pusher 66 rotatably driven by a motor 68 for pushing ice masses with the blade 24 being held fixed, and against which the ice masses are pushed by the rotating pusher.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

20 ice shaving mechanism
22 refrigeration appliance
24 blade
26 edge
28 ice mass
30 layer of ice
32 support
34 opening
36 guide surface
42 bevel
44 edge
46 lateral ends
47 upper surface
48 walls
52 cartridge
54 releasable mounting mechanism
56 refrigerated compartment
58 ice making mechanism
60 ice delivery system
62 ice dispensing system
64 passage
66 pusher
68 motor

The invention claimed is:

1. An ice shaving mechanism comprising:

a cartridge having an opening therethrough formed by at least three walls which also form a guide surface, a blade mounted in the cartridge adjacent to the opening, aligned with one of the walls and arranged with an edge extending beyond a surface of the cartridge to permit the blade to engage an ice mass to shave a layer of ice from the ice mass, the blade edge having two lateral ends and the guide surface comprising an opposing two of the walls being parallel to each other and extending substantially perpendicular to a length of the blade edge and parallel with the two lateral ends of the blade, and arranged to intercept the shaved layer of ice to prevent the shaved layer of ice from laterally spreading in a lateral direction beyond the lateral ends of the blade edge, the guide surface further comprising a surface formed by the third wall to intercept the shaved layer of ice and to direct the shaved layer in a desired direction, the third wall surface having at least a portion that is curved so as to redirect the ice layer intercepted by the guide surface, a releasable mounting mechanism for removably securing the cartridge to a remainder of the ice shaving mechanism.

2. The ice shaving mechanism according to claim 1, wherein the releasable mounting mechanism comprises two threaded fasteners extending though the cartridge.

3. The ice shaving mechanism according to claim 1, wherein the cartridge is formed of molded plastic.

4. The ice shaving mechanism according to claim 1, wherein the blade is permanently mounted in the cartridge.

5. The ice shaving mechanism according to claim 1, wherein the blade is aligned with the third wall forming the opening.

6. The ice shaving mechanism according to claim 1, wherein the opening includes a fourth wall which adjoins the two parallel walls.

7. The ice shaving mechanism according to claim 1, wherein the ice shaving mechanism is mounted in a refrigeration appliance which comprises:

a refrigerated compartment, an ice making mechanism in the refrigerated compartment, an ice delivery system arranged to deliver ice from the ice making mechanism to the ice shaving mechanism, and an ice dispensing system comprising a vertical passage extending downwardly below the ice shaving mechanism.

8. The refrigeration appliance according to claim 1, wherein the ice shaving mechanism comprises a pusher rotatably driven by a motor for pushing ice masses and a fixed blade against which the ice masses are pushed by the rotating pusher.

9. The refrigeration appliance according to claim 1, wherein the ice shaving mechanism comprises a pusher and a blade, at least one of which is rotated relative to the other by a motor.

10. A refrigeration appliance comprising:

a refrigerated compartment, an ice making mechanism in the refrigerated compartment, an ice delivery system arranged to deliver ice from the ice making mechanism, an ice shaving mechanism located in the refrigeration appliance arranged to selectively shave ice received from the ice delivery system, and an ice dispensing system comprising a vertical passage extending downwardly below the ice shaving mechanism, the ice shaving mechanism comprising:

a molded plastic cartridge having an opening therethrough formed by at least three walls which also form a guide surface, a blade permanently mounted in the cartridge adjacent to the opening, aligned with one of the walls and arranged with an edge extending beyond a surface of the cartridge to permit the blade to engage an ice mass to shave a layer of ice from the ice mass, the blade edge having two lateral ends and the guide surface comprising an opposing two of the walls being parallel to each other and extending substantially perpendicular to a length of the blade edge and parallel with the two lateral ends of the blade, and arranged to intercept the shaved layer of ice to prevent the shaved layer of ice from laterally spreading in a lateral direction beyond the lateral ends of the blade edge, the guide surface further comprising a surface formed by the third wall to intercept the shaved layer of ice and to direct the shaved layer in a desired direction, the third wall surface having at least a portion that is curved so as to redirect the ice layer intercepted by the guide surface, a releasable mounting mechanism in the form of two threaded fasteners extending through the cartridge for removably securing the cartridge to a remainder of the ice shaving mechanism.

11. The refrigeration appliance according to claim 10, wherein the ice shaving mechanism comprises a pusher rotatably driven by a motor for pushing ice masses and a fixed blade against which the ice masses are pushed by the rotating pusher.

12. The refrigeration appliance according to claim 10, wherein the ice shaving mechanism comprises a pusher and a blade, at least one of which is rotated relative to the other by a motor.

13. An ice shaving mechanism comprising:

a molded plastic cartridge having an opening therethrough formed by at least three walls which also form a guide surface, a blade permanently mounted in the cartridge adjacent to the opening, aligned with one of the walls and arranged with an edge extending beyond a surface of the cartridge to permit the blade to engage an ice mass to shave a layer of ice from the ice mass, the blade edge having two lateral ends and the guide surface comprising an opposing two of the walls being parallel to each other and extending substantially perpendicular to a length of the blade edge and parallel with the two lateral ends of the blade, and arranged to intercept the shaved layer of ice to prevent the shaved layer of ice from laterally spreading in a lateral direction beyond the lateral ends of the blade edge, the guide surface further comprising a surface formed by the third wall to intercept the shaved layer of ice and to direct the shaved layer in a desired direction, the third wall surface having at least a portion that is curved so as to redirect the ice layer intercepted by the guide surface, a releasable mounting mechanism in the form of two threaded fasteners extending through the cartridge for removably securing the cartridge to a remainder of the ice shaving mechanism.

14. The refrigeration appliance according to claim 13, wherein the ice shaving mechanism comprises a pusher rotatably driven by a motor for pushing ice masses and a fixed blade against which the ice masses are pushed by the rotating pusher.

15. The refrigeration appliance according to claim 13, wherein the ice shaving mechanism comprises a pusher and a blade, at least one of which is rotated relative to the other by a motor.

* * * * *